US011013259B2

(12) United States Patent
Nguyen et al.

(10) Patent No.: US 11,013,259 B2
(45) Date of Patent: May 25, 2021

(54) CIGAR TUBE

(71) Applicant: THINGYMAJIGGY LLC, Marrero, LA (US)

(72) Inventors: Dang Nguyen, New Orleans, LA (US); Thuylinh Nguyen, New Orleans, LA (US)

( * ) Notice: Subject to any disclaimer, the term of this patent is extended or adjusted under 35 U.S.C. 154(b) by 0 days.

(21) Appl. No.: 15/626,129

(22) Filed: Jun. 18, 2017

(65) Prior Publication Data

US 2018/0360109 A1 Dec. 20, 2018

(51) Int. Cl.

| | |
|---|---|
| ***A24F 13/18*** | (2006.01) |
| ***A24F 15/18*** | (2006.01) |
| ***B65D 85/12*** | (2006.01) |
| ***A24F 17/00*** | (2006.01) |
| ***A24B 15/28*** | (2006.01) |
| ***F23Q 2/36*** | (2006.01) |
| ***F23Q 7/16*** | (2006.01) |
| ***F23Q 2/32*** | (2006.01) |
| ***F23Q 3/01*** | (2006.01) |

(52) U.S. Cl.

CPC ..... *A24F 15/18* (2013.01); *A24B 15/282* (2013.01); *A24F 13/18* (2013.01); *A24F 17/00* (2013.01); *B65D 85/12* (2013.01); *F23Q 2/32* (2013.01); *F23Q 2/36* (2013.01); *F23Q 3/01* (2013.01); *F23Q 7/16* (2013.01)

(58) Field of Classification Search

CPC ..... B65D 85/12; A24F 13/18; A24F 13/14; A24F 13/12; A24F 15/18; A24F 15/08; A24F 19/14; A24F 13/08; A24F 13/02; A24F 19/0035; A24F 19/0064; A24F 19/02; A24F 17/00

USPC ..... 206/246, 236; 131/256

See application file for complete search history.

(56) References Cited

U.S. PATENT DOCUMENTS

| | | | | |
|---|---|---|---|---|
| 2,047,786 A | | 7/1936 | Kuntz | |
| 2,120,027 A | * | 6/1938 | Johnson | A24F 13/18 131/256 |
| 2,335,674 A | * | 11/1943 | Horlick | A24F 13/18 131/256 |
| 3,978,981 A | | 9/1976 | Musick | |
| 4,682,611 A | * | 7/1987 | Chiu-Rong | A24F 13/14 131/175 |

(Continued)

*Primary Examiner* — Steven A. Reynolds

(74) *Attorney, Agent, or Firm* — Norton IP Law Firm LLC; Taylor M. Norton

(57) ABSTRACT

A cigar tube is provided having an ash catcher and an ash collection cap, for receiving and containing lit or extinguished cigars for later consumption an elongated tubular member having opposite first and second ends and defining a hollow inner cavity disposed between the first and second ends adapted to receive and contain a cigar. The ash catcher is disposed within the inner cavity and has a generally planar body positioned transverse to the tubular member and has a plurality of apertures. A plurality of truncated cones project from the planar body such that each truncated cone preferably aligns with each respective aperture to provide substantially unidirectional ash passageways from the inner cavity to the ash collection cap. In a preferred embodiment, the truncated cones have a length sufficient to provide air space between the cones and the ash collection cap for the collection of ashes and dissipation of heat.

12 Claims, 18 Drawing Sheets

(56) References Cited

U.S. PATENT DOCUMENTS

| | | | | |
|---|---|---|---|---|
| 4,982,746 | A * | 1/1991 | Pruyne | A24F 13/18 131/235.1 |
| 5,345,953 | A * | 9/1994 | Taylor | A24F 13/18 131/256 |
| 5,385,157 | A * | 1/1995 | Smith | A24F 13/18 131/235.1 |
| 6,109,271 | A | 8/2000 | Webber et al. | |
| 2002/0104546 | A1* | 8/2002 | Brown | A24F 19/14 131/235.1 |
| 2003/0024540 | A1 | 2/2003 | Gibertini | |
| 2008/0128301 | A1* | 6/2008 | Bourgoin | B65D 85/1054 206/268 |
| 2016/0095353 | A1* | 4/2016 | Liu | A24F 15/10 206/86 |
| 2016/0221707 | A1* | 8/2016 | Xu | B65D 1/09 |

* cited by examiner

CIGAR TUBE

BACKGROUND OF THE INVENTION

Field of the Invention

The present invention relates generally to cigars, and more particularly, to a cigar receiving tube, an ash catcher and ash retainer cap for a cigar.

Description of the Related Art

It is well known that tobacco leaves are shredded into grinds, flakes, fine shreds or strands which are laid into a binder leaf such as a Havana leaf and rolled into cigar form, often then wrapped with a thin tobacco leaf as the outside wrapper, the sheath, to form a cigar.

Cigar holders have been described in the prior art; however, none of the prior art devices disclose the unique features of the present invention.

Conventional cigar tubes have a number of limitations and disadvantages. Representative examples of them include U.S. Pat. No. 2,047,786, dated Jul. 14, 1936, to Kuntz, in which is disclosed an invention which relates to improvements in cigarette and cigar holders, and has for an object among others the provision of means for holding a cigarette over an ashtray in such a manner as to insure the cigarette or any part of it or the ashes thereof from falling on the table, which means may be made in one or more pieces. It also has for an object the provision of such a holder wherein the cigarette held will deposit its ashes in the ashtray and to which the cigarette will not stick. U.S. Pat. No. 6,109,271, dated Aug. 29, 2000, to Webber, et al., disclosed a cigar holder for a vehicle which is formed with one portion to support a cigar and another portion of non-heat conducting and weather resistant material to protect the vehicle from the heat of the cigar and the cigar holder from the deleterious effects of the weather. The cigar holder is attached to the vehicle by a suction cup which is concealed by an insert which is selectable to give the cigar holder different appearances. In U.S. patent application Ser. No. 09/920,483 published Feb. 6, 2003, Gibertini disclosed a cigar caddie that has an elongated part tubular and part semi-tubular member for holding a cigar in the semi-tubular portion, and a hook or other securing member to secure the cigar caddie to a golf bag or golf cart. When the golfer is ready to make his next shot, he can put his lit cigar in the semi-cylindrical receiving cavity of the cigar caddie which has been secured to the golf bag or cart by placing the hook over the upper edge of the golf bag or over an available portion of the frame of the golf cart. The cigar caddie can be easily and quickly hooked onto the golf bag or cart and just as easily and quickly removed therefrom. Such aforementioned devices are complex and do not provide for or accommodate advantages of the present invention. Another type of cigar holder is illustrated in U.S. Pat. No. 3,978,981 to Musick. This device differs from the other devices in that it is not intended to be used as a cigar extinguisher. The Musick device comprises a receptacle for receiving the lighted end of the cigar and the receptacle has a mesh venting screen to permit the cigar to burn. As a result, this type of device could not easily be carried in a pocket of a user. As the cigar continues to burn and give off smoke, the user could inhale the smoke. Further, the user's clothing will become permeated with the smoke odor. Such conventional device does not provide for or accommodate advantages of the present invention.

While these cigar holders may be suitable for the purposes for which they were designed, they would not be as suitable for the purposes or exhibit the advantages of the present invention, as hereinafter described.

It is an object of this invention to provide a device for extinguishing, containing, carrying, and preserving a cigar. It is another object of this invention to provide a device for receiving, containing and disposing of the ashes of a burnt end of a cigar or other smoking article.

It is a further object of the present invention to provide a device as above which will accommodate cigars and various smoking articles of different lengths and dimensions. It is yet another object of the present invention to provide a device that slices the sheath of a cigar and contains the tobacco filling, at the option of the user. Another object of the invention is to provide product packaging for a variety of smoking articles, as disclosed herein.

It is a further object of the present invention to provide a device as above which may be carried within the pocket of the user's apparel.

A further objective of the present invention is to provide an apparatus which is easy to use and manufacture.

To overcome the limitations of the prior art described above, and to overcome other limitations that will become apparent upon reading and understanding the present specification, embodiments of the present invention provide a cost effective device and simplified means for receiving a cigar and receiving and retaining burnt ashes or tobacco grinds apart from the cigar.

As will be described in more detail below, embodiments of the present invention provide a structure, method and combination of scope and function completely different than the prior art.

These and further objects and advantages will become more apparent from the following description and drawings in which like reference numerals depict like elements.

SUMMARY OF THE INVENTION

The following present a simplified summary of the present disclosure in a simplified form as a prelude to the more detailed description that is presented herein.

Embodiments of the present invention are generally directed to a cigar tube comprising an elongated tubular member having opposite first and second ends. The tubular member has a hollow inner cavity between the first and second ends, and the tubular member is configured to receive a cigar through the first end and contain a cigar within the inner cavity. An end cap is removeably connected to the first end for retaining the cigar in the inner cavity.

In a preferred embodiment, an ash catcher is disposed within the inner cavity. The ash catcher has a generally planar body and is positioned or oriented transverse to the tubular member and has a plurality of apertures. A plurality of truncated cones project from the planar body, and each of the truncated cone preferably aligns with each respective aperture to provide substantially unidirectional ash passageways from the inner cavity to an ash collection cap which is fluted to the second end of the tubular body.

The ash collection cap preferably has an annular wall and is removeably attached to the second end of the cigar tube for the receipt, containment and disposal of ashes or tobacco strands from cigars.

The cigar tube is preferably adapted to receive and enclose an entire lit cigar such that ashes from the lit end are directed to fall through the inner cavity of the tube and pass through the ash catcher and into the ash collection cap.

In one embodiment, the tubular member of the cigar tube is adapted to receive and closely surround a portion of a lit cigar while an opposing unlit portion of the cigar extends outwardly from the opening of the cigar tube such that, when the cigar is smoked by a user, ashes from the lit end of the cigar are configured to fall through the ash catcher and into the ash collection cap which is attached to the other end of the tube. The ash collection cap contains the ashes until disposed of, at the option of the user.

In one embodiment, the cigar tube comprises an annular ring encircling an interior surface of the tubular member, and the ash catcher is fitted against that annular ring and preferably held in place by the annular wall of the ash collection cap when connected to the second end.

In a preferred embodiment, the annular wall of the ash collection cap further comprises one or more outer annular ribs to facilitate a tightly sealed connection to the second end of the tubular member.

In yet another embodiment, the ash collection cap is preferably configured as statically charged to facilitate increased attraction and retention of ashes within the statically charged collection cap.

The truncated cones of the ash catcher are preferably characterized as having a length sufficient to dissipate heat of lit ashes that pass through the ash catcher into the ash collection cap. The truncated cones are preferably of a length sufficient to provide air space between the cones and the ash collection cap for the collection of ashes and dissipation of heat when the cap is connected to the cigar tube.

In yet another embodiment, a blade is attached to an interior surface of the tubular member and is configured to longitudinally slice through an outer sheath of a cigar when it is inserted through the opening of the first end into the inner cavity.

In yet another preferred embodiment, a cigar tube device is provided with a tubular member having a top end opposite a bottom end, and the top end defines an opening to an inner cavity that is adapted to receive and hold the full length of a cigar.

In such embodiment, a top cap is removeably attached to the top end, and an ash collection cap is removeably connected to the bottom end. Such embodiment further comprises a plurality of truncated cones having truncated distal ends opposite interconnected base ends forming a sieved wall disposed within the tubular member for the passage of ashes from the inner cavity to the ash collection cap.

In one embodiment, one end of the cigar is lit and the plurality of truncated cones are adapted to dissipate the heat of hot ashes from a lit cigar when inserted into the cigar tube.

In such preferred embodiment, the plurality of truncated cones forming a sieved wall is configured to retain substantially all the ashes within the ash collection cap upon passage of the ashes through the truncated cones into the collection cap.

In yet another preferred embodiment, there is provided a cigar tube for receiving, slicing, and storing smoking articles such as, for instance a cigar and cigar filling tobacco, comprising a tubular member having a top end opposite a bottom end, where the top end defines an opening to an inner cavity that is adapted to receive and contain the cigar and cigar filling tobacco when inserted therein by a user. Such embodiments provide for the removal and disposal of ashes and/or tobacco strands from smoking articles such as a cigar, in a clean and efficient manner. Through various embodiments disclosed herein, the cigar tube also provides for product packaging for smoking articles, such as, for instance, cigars, rolling papers, cigar wraps, hemp-based rolling papers, pre-rolled cones, tobacco strands, marijuana (including medical grade marijuana), and/or cannabis (including medical grade cannabis).

In another embodiment, a top cap is removeably attached to the top end of the cigar tube, and a blade is preferably attached to the inside wall of the cigar tube and configured to slice through an outer sheath of a cigar when the cigar is inserted through the opening into the inner cavity of the cigar tube. Such embodiment preferably comprises a tobacco, cannabis or ash collection cap removeably connected to the bottom end.

Such embodiment preferably comprises an ash catcher forming a cross-sectional wall relative to the inner cavity wherein the ash catcher has a plurality of truncated cones projecting from one side of the wall to provide passageways for tobacco strands into the tobacco filling collection cap.

The tubular member is preferably elongated and characterized as having a length in excess of the length of the cigar or rolling papers. In one embodiment, the tubular member is characterized as having a length of at least three inches.

In yet another preferred embodiment, a tubular device for receiving and containing smoking articles is provided, comprising a tubular member having a top end opposite a bottom end, said top end defining an opening to an inner cavity adapted to receive and contain smoking articles; a top cap removeably attached to the top end; an ash collection cap removeably attached to the bottom end; and a plurality of truncated cones having truncated distal ends opposite interconnected base ends forming a sieved wall disposed within said tubular member for the passage of ashes from the inner cavity to the ash collection cap.

In yet another embodiment, the invention describes a rolling paper container for the containment and dispensing of smoking articles, such as, for instance for rolling papers. Embodiments of the present invention make it possible to present the rolling papers more easily to the user.

In another embodiment, the tubular device is characterized as having a color configured to inform a user as to the contents of said smoking articles contained within said inner cavity.

In yet another embodiment, there is provided tubular device for receiving and containing smoking articles comprising a tubular member having a top end opposite a bottom end, said top end defining an opening to an inner cavity adapted to receive and contain smoking articles; a top cap removeably attached to the top end; an ash collection cap removeably attached to the bottom end; and a plurality of truncated cones having truncated distal ends opposite interconnected base ends forming a sieved wall disposed within said tubular member for the passage of ashes from the inner cavity to the ash collection cap.

Such tubular device is preferably cylindrical in shape. In one embodiment, the tubular device is conical in shape. The smoking articles can comprise, for instance, rolling papers, pre-rolled cones, tobacco strands, marijuana, cannabis, and/or cigar wraps, among other similar smoking articles.

Preferably, the top cap further comprises a flavor enhancement mechanism, such that, when smoking articles are contained within the tubular device and engage the flavor enhancement mechanism, the mechanism provides an enhancement to a taste and/or scent of the smoking articles.

In a preferred embodiment, the tubular device is constructed with a dye characterized as having a color configured to inform a user as to the contents of the smoking articles contained within the device. In another embodiment, there is provided a cigar tube comprising a scratch box having a thin film layer disposed on the outer surface of the tube. A user can scratch away all or portions of the scratch box such that the scratch box can be used for identification of the contents contained within the tube.

In one embodiment, the top cap further comprises a battery operatively coupled to a lighter disposed within the top cap which is configured to lite smoking articles at the option of the user.

In one embodiment, the top cap has a writing instrument, such as a pen or a pencil, disposed upon the outer surface of the top cap. In another embodiment, the top cap further comprises a writing instrument attached to an inner portion of the top cap, such that it can be inserted into the inner cavity of the tubular device. In yet another embodiment, the ash collection cap has a writing instrument attached to an outward or bottom portion of the ash collection cap.

BRIEF DESCRIPTION OF THE DRAWINGS

Illustrative embodiments of the present invention are described herein with reference to the accompanying drawings, in which.

DETAILED DESCRIPTION

Figure 1:
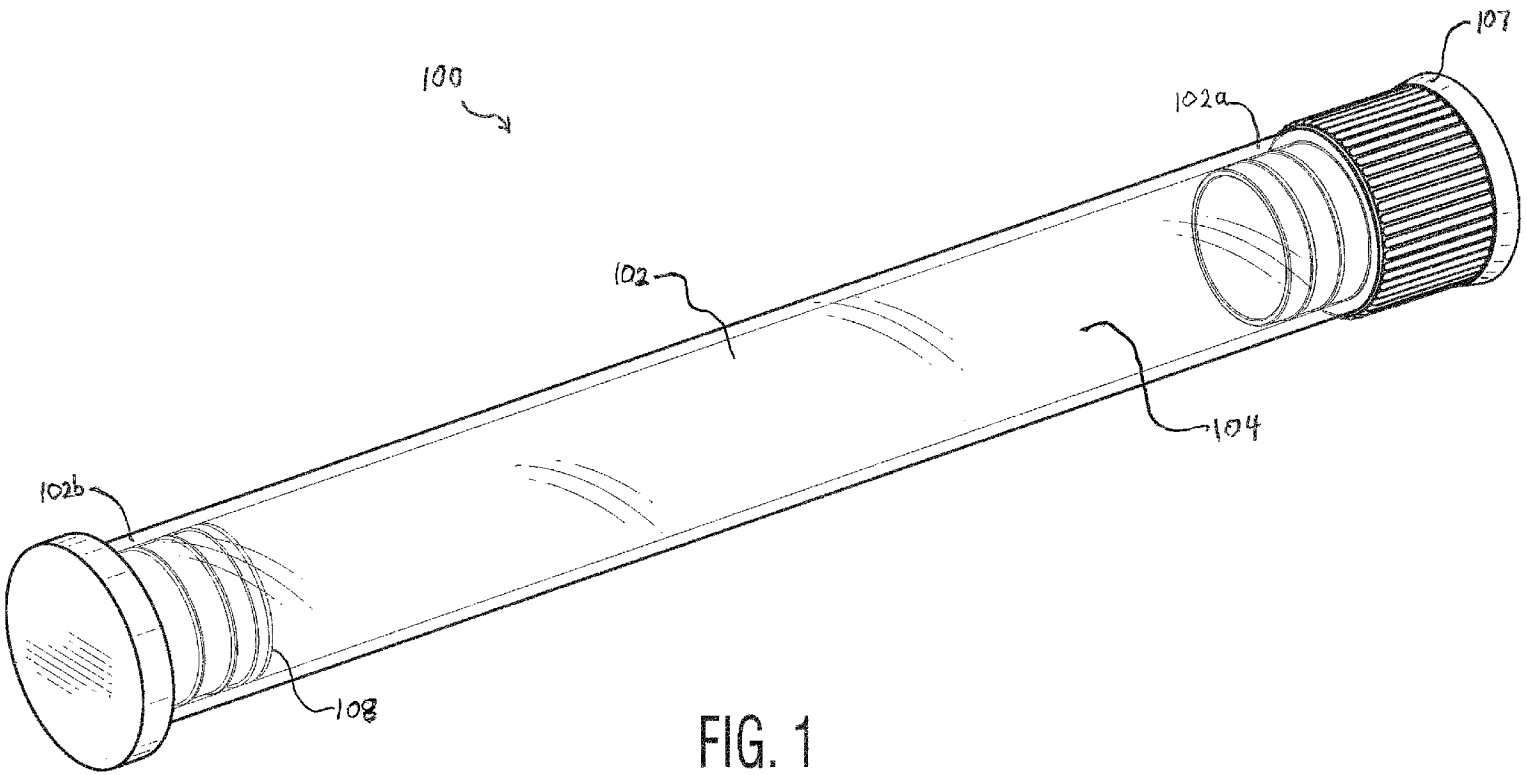
FIG. 1 is a bottom perspective view of a cigar tube with top end cap, bottom end cap and ash catcher, according to a preferred embodiment of the present invention.

Persons of ordinary skill in the art will realize that the following disclosure is illustrative only and not in any way limiting. Other embodiments of the disclosure will readily suggest themselves to such skilled persons having the benefit of this disclosure. As previously noted, the device of the present invention is designed to rapidly extinguish a lighted cigar and preserve it for later use. The device is further designed to efficiently collect, contain and dispose of ashes or tobacco strands of a cigar or other smoking article, at the option of the user, and to be carried by the user and to prevent the transfer of undesirable tobacco juices and smoke odors to the user's apparel. In addition, the device is designed to accommodate cigars of different lengths and diameters.

The present disclosure is generally directed to a cigar tube comprising an elongated tubular member having opposite first and second ends, a top end cap disposed on the first end, an ash collection cap disposed on the second end, and an ash catcher disposed between the two ends. Turning now descriptively to the drawings, in which similar reference characters denote similar elements through several views which illustrate embodiments of the present invention.

Referring initially to FIGS. 1-6, the basic constructional details, principles of operation and arrangement of an exemplary cigar tube device 100 according to a preferred embodiment of the present invention will be discussed.

Turning to FIGS. 1-4, a cigar tube device 100 according to a preferred embodiment of the present invention is provided. The cigar tube device 100 comprises a preferably elongated tubular member 102 having opposite first 102*a* and second 102*b* ends. The tubular member 102 defines a hollow inner cavity 104 between the first 102*a* and second 102*b* ends, and the tubular member 102 is configured to receive a cigar 106 through the first end 102*a* and closely surround the cigar 106 within the inner cavity 104. A first end cap 107 is removeably connected to the first end 102*a* of the tubular member 102, an ash catcher 108 is disposed within the inner cavity 104 and preferably positioned at the second end 102*b* of the tubular member 102, and an ash collection cap 116 is removeably connected to the second end 102*b*, for retaining the cigar 106 inside the inner cavity 104. In such embodiments, the cigar 106 can be fully enclosed within and confined to the cigar tube 100. The cigar tube 100 may have any desired length and any desired inner and outer diameters. Preferably, the tubular member 102 of the cigar tube 100 is of a size sufficient to permit the accommodation of cigars of different lengths and diameters.

Figure 2:
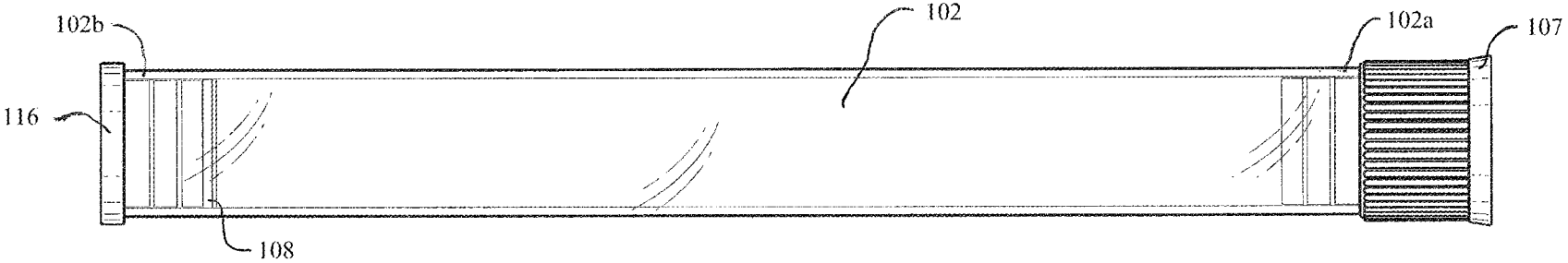
FIG. 2 is a right side view thereof, the left side view being a mirror image of the right side view.
Figure 4:
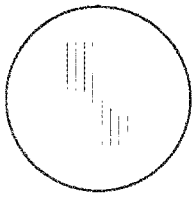
FIG. 4 is a top view thereof.
Figure 3:
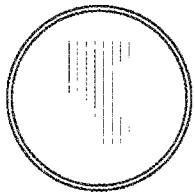
FIG. 3 is a bottom view thereof.
Figure 5:
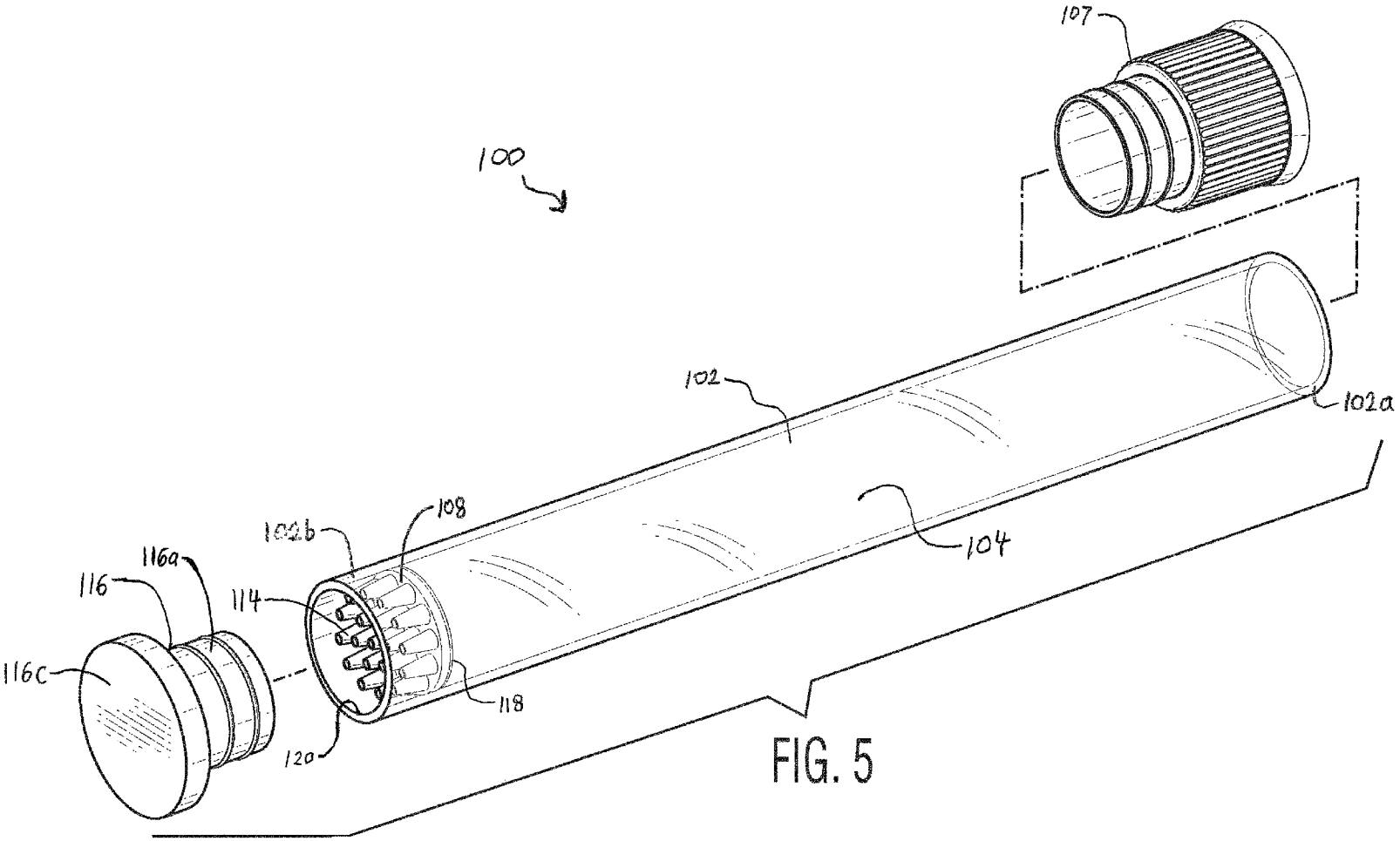
FIG. 5 is a partially exploded bottom perspective view of embodiments showing cigar tube top and bottom end caps removed and partially revealing the ash catcher, according to preferred embodiments.

As seen in FIG. 5, in a preferred embodiment, an ash catcher 108 is disposed within the inner cavity 104 of the cigar tube 100. The ash catcher 108 has a generally planar body 110 having a top surface portion 110*a* opposite a bottom surface portion 110*b*, and is preferably positioned or oriented transverse to the tubular member 102 as shown in FIG. 2. The generally planar body 110 of the ash catcher 108 defines a plurality of apertures 112 and comprises a plurality of truncated cones 114 that project from the bottom surface portion 110*b* of the planar body 110. Preferably, each truncated cone 114 concentrically aligns with each respective aperture 112 to provide substantially unidirectional (in the direction exemplified by arrow A in FIG. 11 and FIG. 16) ash/tobacco strand passageways from the inner cavity 104 to the ash collection cap 116 which is fitted to the second end 102*b* of the tubular body 102, as further illustrated in FIGS. 7-8.

Figure 6:
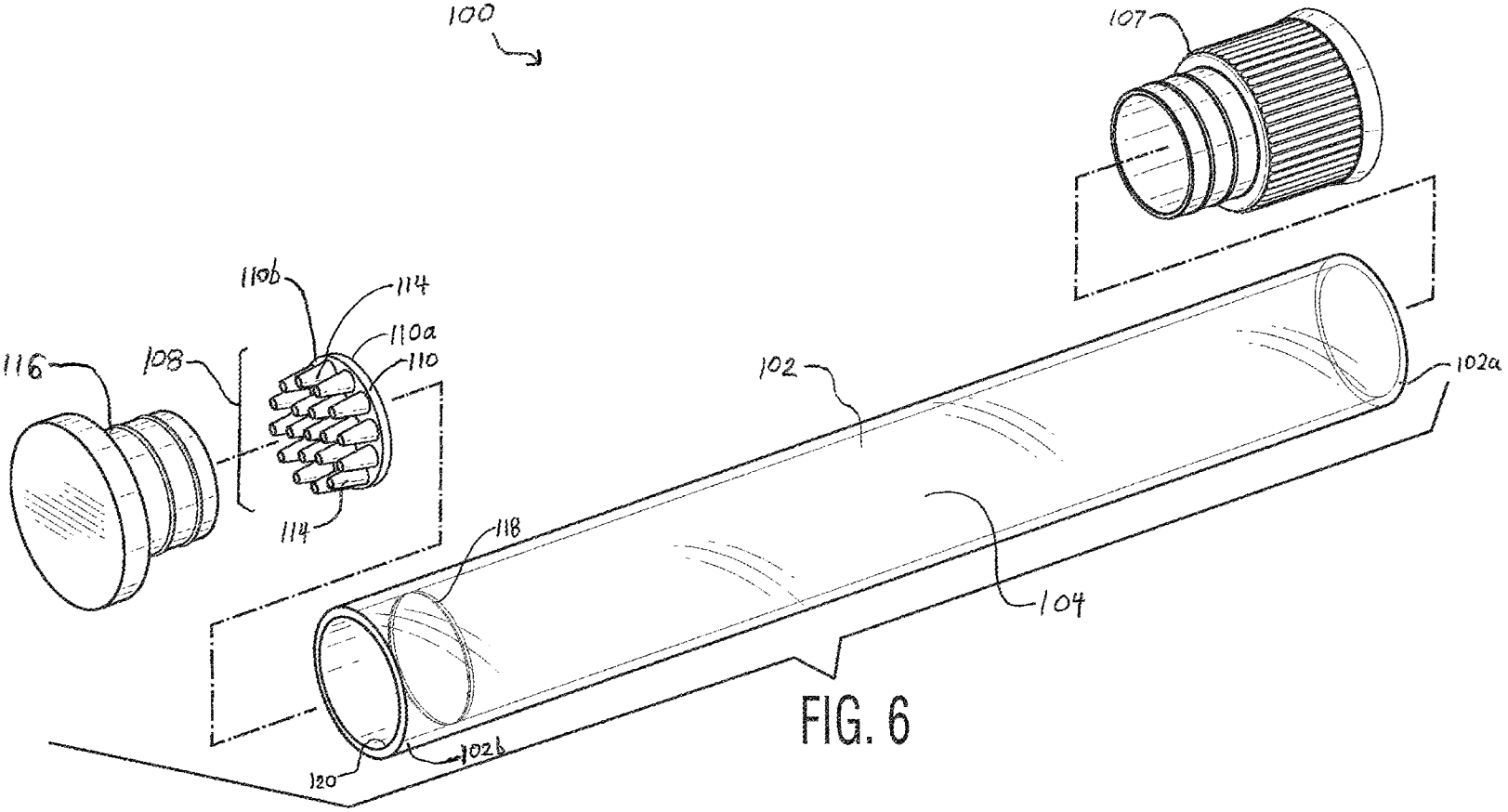
FIG. 6 is an exploded bottom perspective view thereof with the end caps and ash catcher removed.
Figure 7:
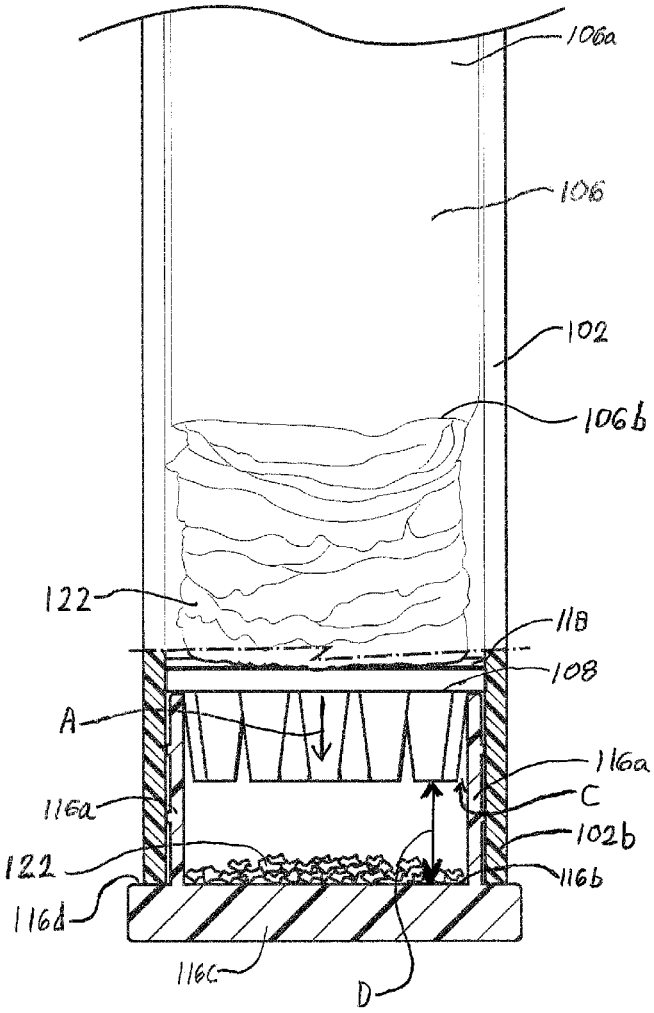
FIG. 7 is a side view, partly in cross section, of the cigar tube with exemplary ashes contained within the bottom end ash collection cap, according to preferred embodiments of the present invention.
Figure 8:
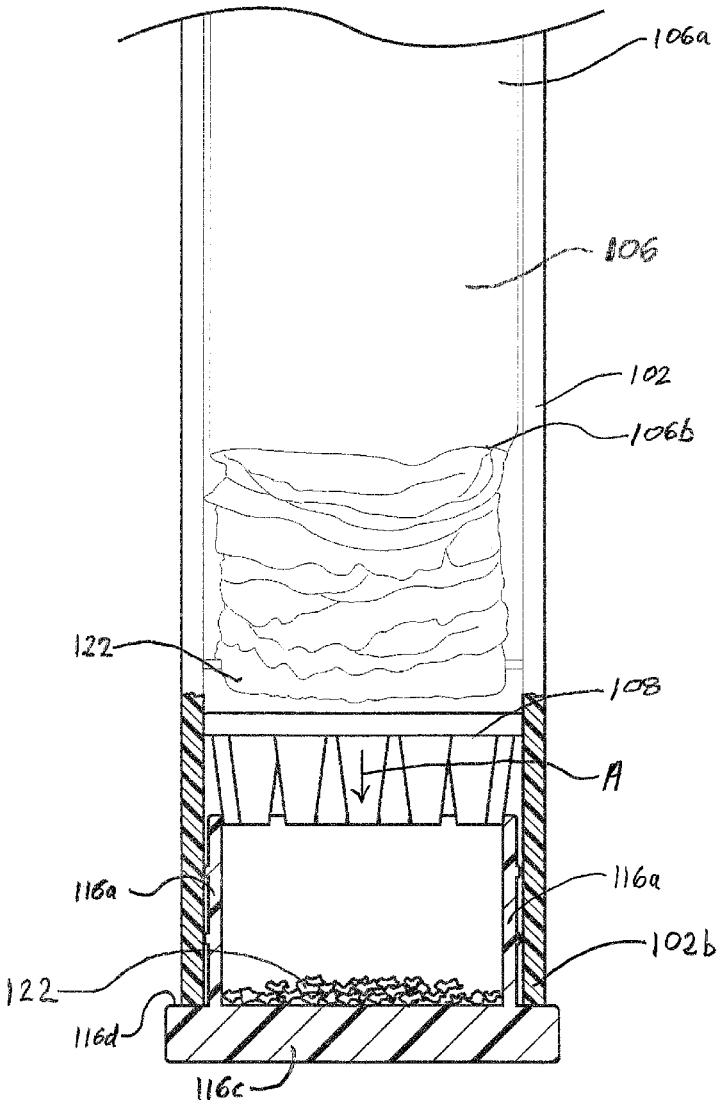
FIG. 8 is a side view, partly in cross section, of the cigar tube with exemplary ashes contained within an alternative bottom end ash collection cap, according to another embodiment of the present invention.

Referring to FIG. 5-6, the cigar tube 100 preferably comprises an annular ring 118 encircling an inner surface 120 of the tubular member 102, and the ash catcher 108 is fitted against that annular ring 118 and preferably held in place by an annular wall 116*a* of the ash collection cap 116, when the collection cap 116 is connected to the second end 102*b* of the tubular member 102, as seen in FIG. 7. In an alternative embodiment, the annular wall 116*a* of the ash collection cap 116 does not engage and abut the ash catcher 108 when the collection cap 116 is connected to the second end 102*b* of the tubular member 102, as seen in FIG. 8. In such alternative embodiment, the ash catcher 108 is removeably held in place within the inner cavity 104 by friction forces created by the ash catcher 108 fitting tightly within and against the inner surface 120 of the tubular member 102; or alternatively, the ash catcher 108 is held in place within the inner cavity 104 by more permanent means such as epoxy or glue. In yet another embodiment, the ash catcher 108 can be permanently held in place within the tubular member 102 as a molded element of a single piece of unitary construction of the tubular member 102.

As illustrated in FIGS. 7-8, in a preferred embodiment, the ash collection cap 116 preferably has an annular wall 116*a* that is removeably connected to and tightly fitted within the second end 102*b* of the cigar tube 100 for the receipt, containment and disposal of ashes 122 or tobacco strands 122 from smoking articles, such as cigars 106, as such ashes 122 or tobacco strands 122 pass through the ash catcher 108. The annular wall 116*a* of the ash collection cap 116 telescopically fits into the hollow second end 102*b* of the tubular member 102 of the cigar tube 100 to form a sealed container. Opposite the annular wall 116*a* of the ash collection cap 116 is a bottom wall 116*c* of the ash collection cap 116. The bottom wall 116*c* portion of the collection cap 116 is preferably characterized as having a diameter greater than the diameter of the annular wall 116*a*, so as to form an outer lip 116*d*.

The ash collection cap 116 can be removed from the tubular member 102, at the option of the user, for instance, when the cap 116 has been filled up with ashes 122 or tobacco strands 122 from smoking articles 106, at which point a user can conveniently, efficiently, and cleanly dispose of such ashes 122 or tobacco strands 122 in the trash or elsewhere, without the user having to actually touch the ashes 122 or tobacco strands 122.

As seen in FIGS. 7-8, one end of the cigar is lit and the plurality of truncated cones 114 are adapted to dissipate the heat of hot ashes 122 from a lit cigar when inserted into the cigar tube 100. Preferably, the plurality of truncated cones 114 are characterized as having a length sufficient to dissipate heat such that a user does not feel such heat when the cigar tube 100 is residing within the user's clothing.

Figure 9:
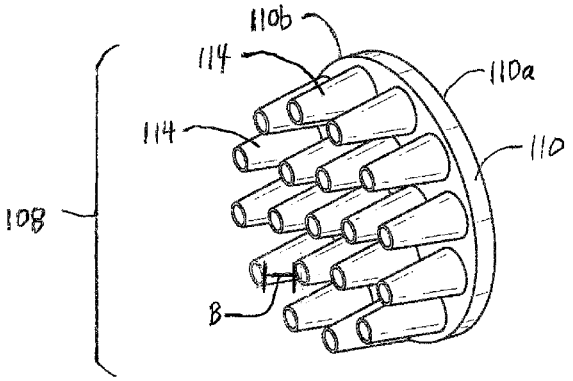
FIG. 9 is a bottom perspective view of the ash catcher of the cigar tube, according to an embodiment of the present invention.
Figure 10:
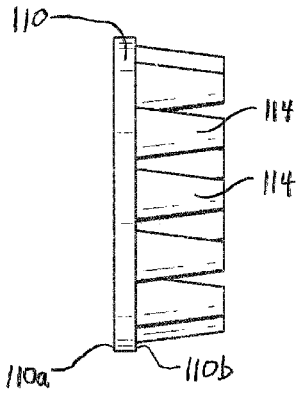
FIG. 10 is a left edge view of the ash catcher, the right edge view being a mirror image.
Figure 11:
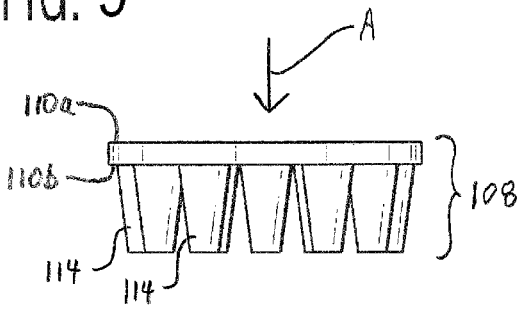
FIG. 11 is a top edge view of the ash catcher, the bottom edge view being a mirror image.
Figure 12:
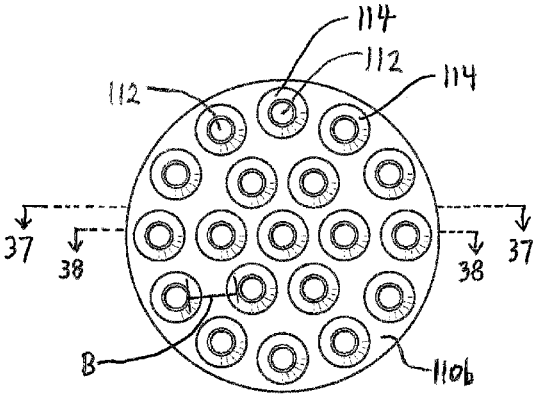
FIG. 12 is a bottom face view of the ash catcher.
Figure 13:
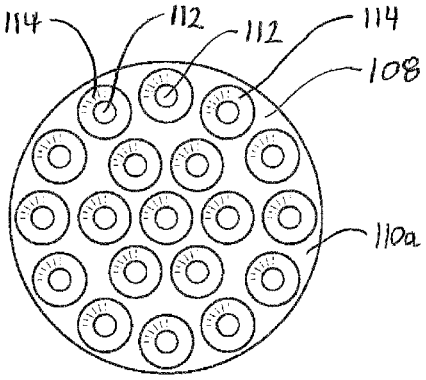
FIG. 13 is a top face view of the ash catcher.
Figure 14:
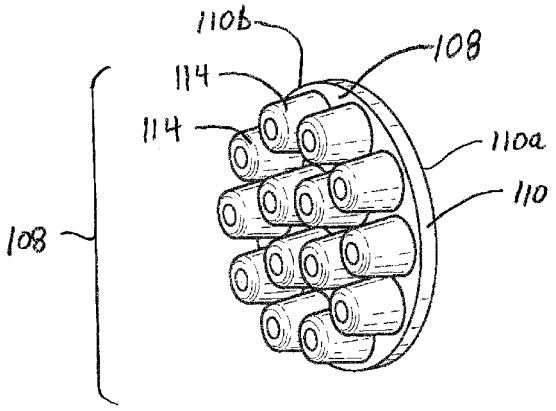
FIG. 14 is a bottom perspective view of an alternative embodiment of the ash catcher of the cigar tube, according to another embodiment of the present invention.
Figure 15:
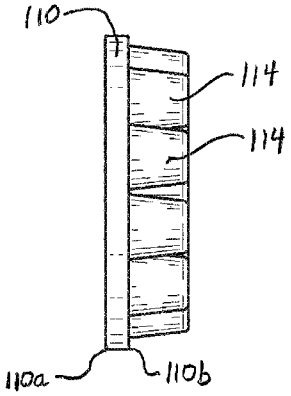
FIG. 15 is a left edge view the ash catcher thereof, the right edge view being a mirror image.
Figure 16:
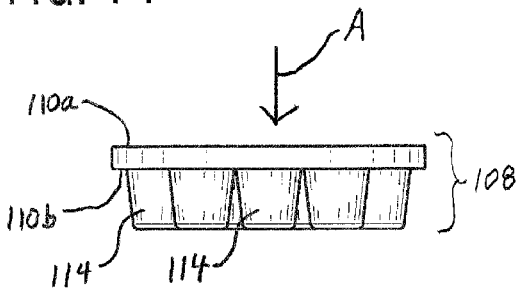
FIG. 16 is a top edge view the ash catcher thereof, the bottom edge view being a mirror image.
Figure 17:
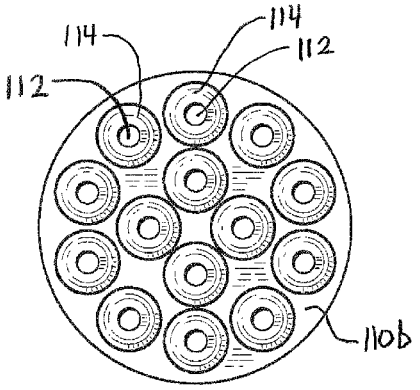
FIG. 17 a bottom face view the ash catcher thereof.
Figure 18:
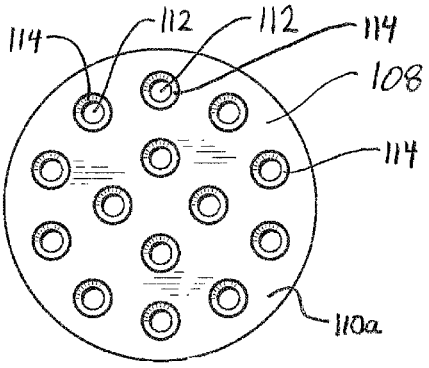
FIG. 18 is a top face view of the ash catcher thereof.

FIGS. 9-11 provide a bottom perspective view, a left edge view, and a top edge view, respectively, of an ash catcher 108 according to one embodiment of the invention. FIGS. 12-13 provide a bottom face view and a top face view of the ash catcher 108 according to such embodiment. FIGS. 14-16 provide a bottom perspective view, a left edge view, and a top edge view, respectively, of an ash catcher 108 according to an alternative, preferred embodiment of the invention. FIGS. 17-18 provide a bottom face view and a top face view of the ash catcher 108 according to such alternative, preferred embodiment.

Referring to FIGS. 9-18, the truncated cones 114 of the ash catcher 108 are preferably characterized as having sufficient length, spacing, and orientation of cones 114 to dissipate heat of embers of hot ashes 122 that pass through the ash catcher 108 (in the direction exemplified by arrow A) into the ash collection cap 116, as illustrated in FIGS. 7-8.

As seen in FIGS. 12-13 and FIGS. 17-18, the truncated cones 114 are preferably of a length and configured with relative orientation and spacing to provide sufficient air space between the truncated cones 114 themselves (as exemplified by reference distance B shown in FIG. 9 and FIG. 12), as well as to provide sufficient air space between the cones 114 and the ash collection cap 116 annular walls 116*a* (as exemplified by arrow C pointing to exemplary air space shown in FIG. 7), as well as to provide sufficient air space between the cones 114 and the inner bottom wall 116*b* of the ash collection cap 116 (as exemplified by arrow D distance shown in FIG. 7), for the collection of ashes 122 and dissipation of heat when the collection cap 116 is connected to the cigar tube 100.

Referring to FIGS. 22-26, in a preferred embodiment, the annular wall 116*a* of the ash collection cap 116 further comprises outer annular ribs 124 124 to facilitate a tightly sealed connection to the second end 102*b* of the tubular member 102. In yet another embodiment, the ash collection cap 116 is preferably configured as statically charged to facilitate increased attraction and retention of ashes 122 within the statically charged collection cap 116.

In one embodiment, the tubular member 102 of the cigar tube 100 is adapted to receive and closely surround a portion of a lit cigar while an opposing unlit portion of the cigar extends outwardly from the opening of the cigar tube 100 such that, when the cigar is smoked by a user, ashes 122 from the lit end of the cigar are configured to fall through the ash catcher 108 and into the ash collection cap 116 which is attached to the other end of the tube 100. The ash collection cap 116 contains the ashes 122 until disposed of, at the option of the user. The user can cleanly and efficiently dispose of the ashes 122 by removing the ash collection cap 116 from the second end of the tubular member 102 and then pouring the ashes 122 into the trash.

Figures 19, 20:
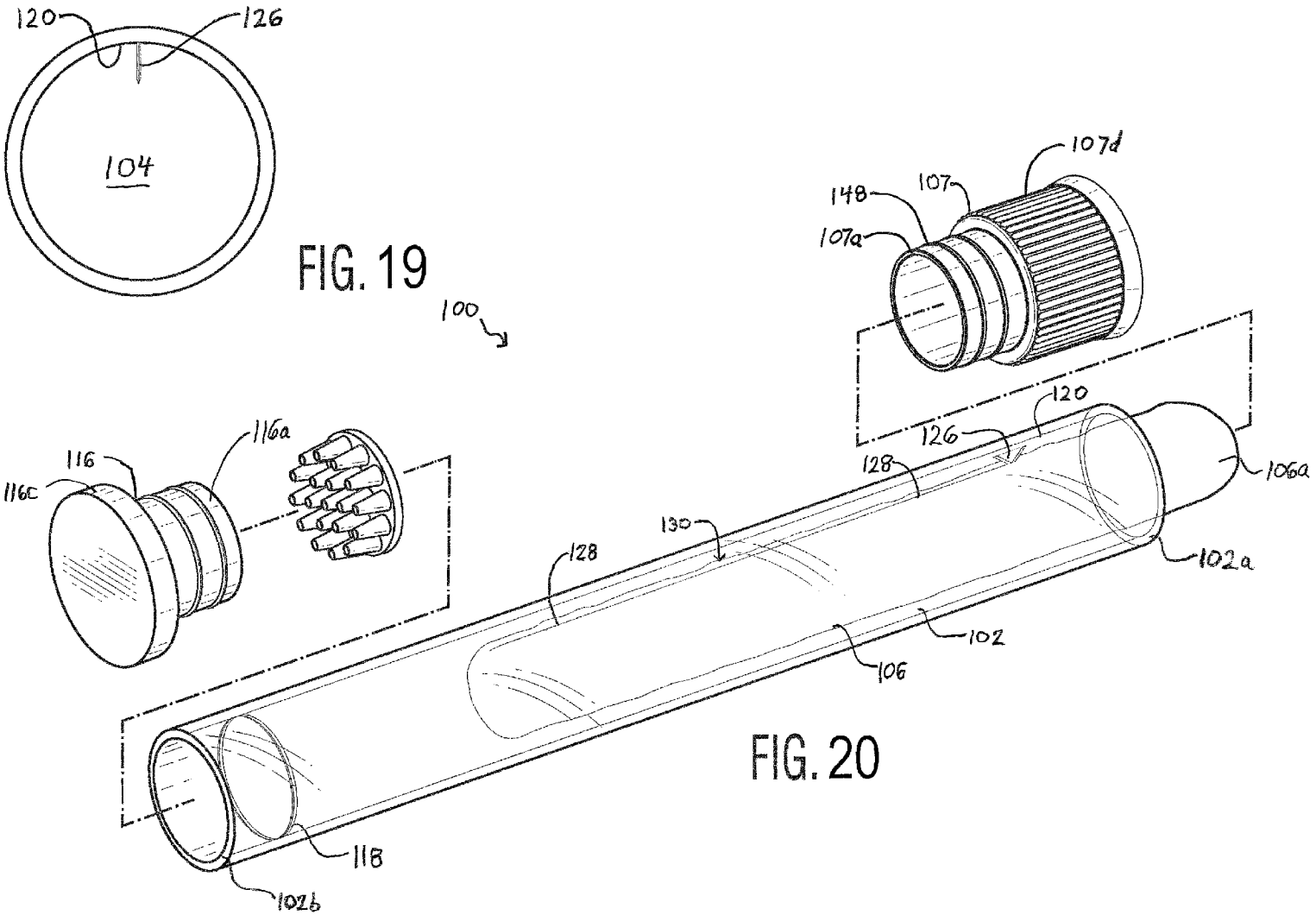
FIG. 19 is an end view of a preferred tubular member with a blade attached to an interior surface of the tubular member of the cigar tube shown in FIG. 20, according to another embodiment of the present invention.
FIG. 20 is an exploded bottom perspective view thereof with the end caps and ash catcher removed, and an exemplary cigar partly inserted into the cigar tube, with a blade attached to an interior surface of the tubular member, according to embodiments of the present invention.

As seen in the embodiments in FIG. 20, the cigar tube 100 is adapted to receive and closely surround a lit portion 106*b* (FIG. 7) of a cigar 106 while an opposing unlit portion 106*a* of the cigar extends outwardly from the opening such that ashes 122 from the lit end of the cigar are directed to fall through the inner cavity 104 and pass through the ash catcher 108 and into said ash collection cap 116, which retains the ashes 122 for disposal at the option of the user.

In yet another embodiment, the cigar tube 100 is adapted to receive and closely surround a portion of a lit cigar while an opposing unlit portion of the cigar extends outwardly from said opening such that, when said cigar is smoked, ashes 122 from the lit end are configured to fall and/or pass through the ash catcher 108 and into said ash collection cap 116, which retains most of such ashes. The ashes 122 are retained in the ash collection cap 116 until the collection cap 116 is removed by the user for emptying. When the lit end of a cigar is disposed within the inner cavity 104, that lit end can either be in direct contact with or have no direct contact with the ash catcher 108, at the option of the user.

Figure 21:
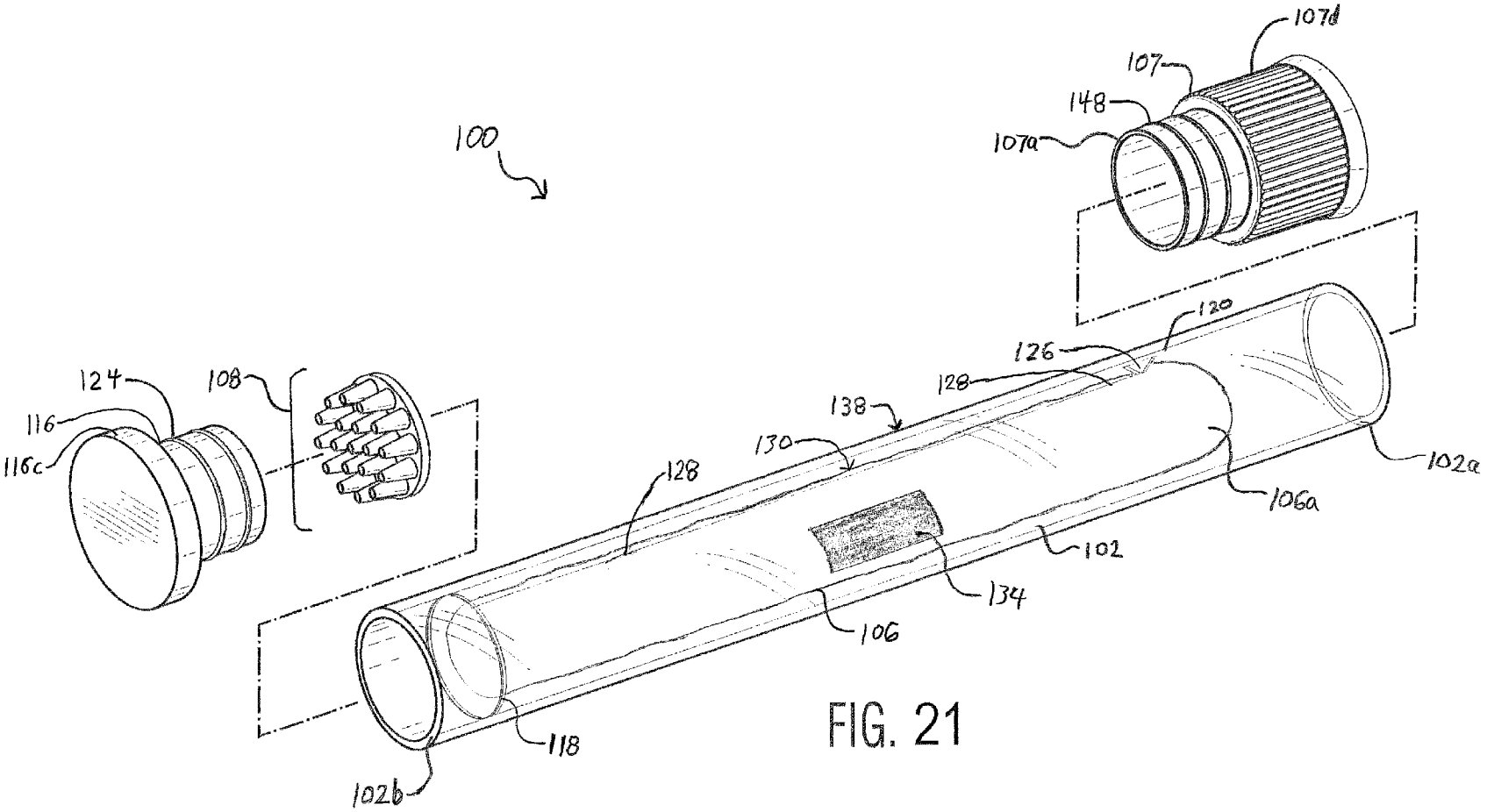
FIG. 21 is an exploded bottom perspective view thereof with the end caps and ash catcher removed, and an exemplary cigar fully inserted into the cigar tube, with a blade attached to an interior surface of the tubular member, and with a scratch box preferably disposed on the outer surface of the cigar tube, according to embodiments of the present invention.
Figure 22:
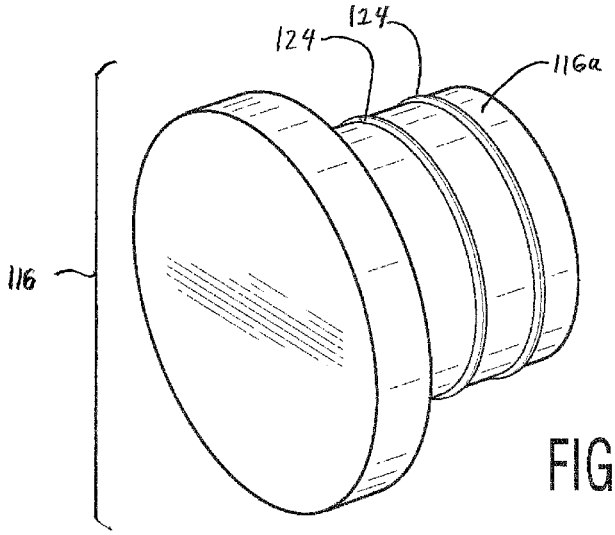
FIG. 22 is a bottom perspective view of the bottom end cap of the cigar tube, according to a preferred embodiment of the present invention.
Figure 23:
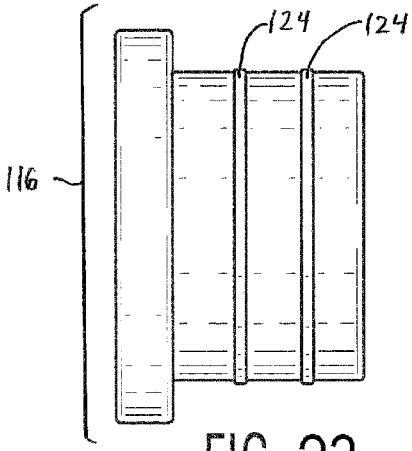
FIG. 23 is a right side view of the bottom end cap thereof, all other side views being a mirror image.
Figure 24:
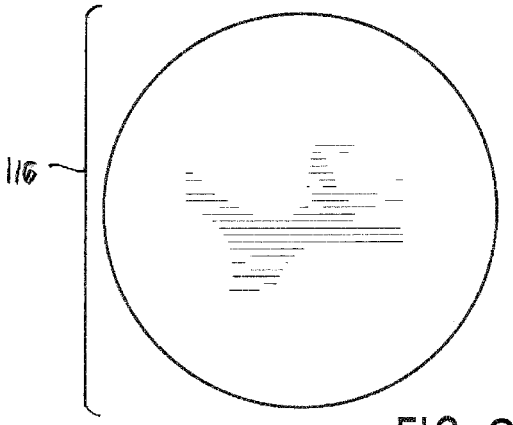
FIG. 24 is a bottom face view of the bottom end cap thereof.
Figure 25:
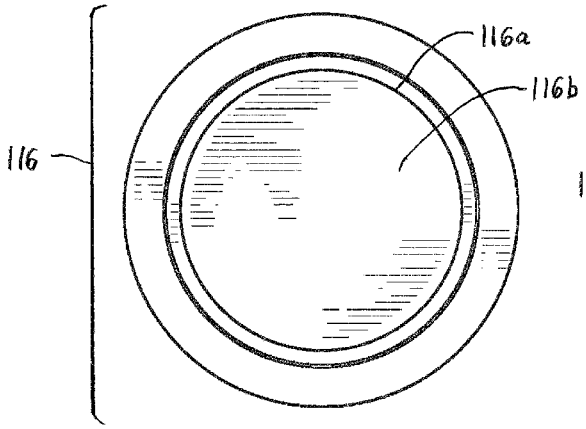
FIG. 25 is a top face view of the bottom end cap thereof.
Figure 26:
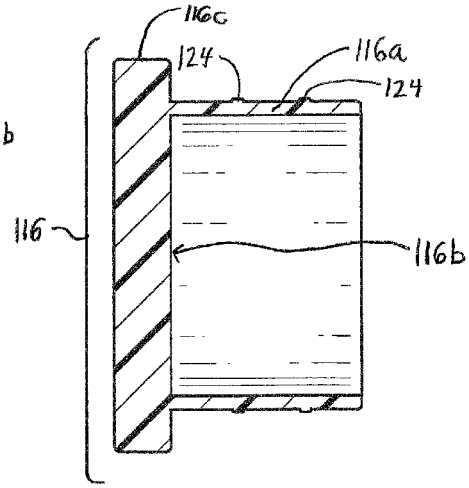
FIG. 26 is a cross-sectional view of the bottom end cap thereof disclosing interior of cap.
Figure 27:
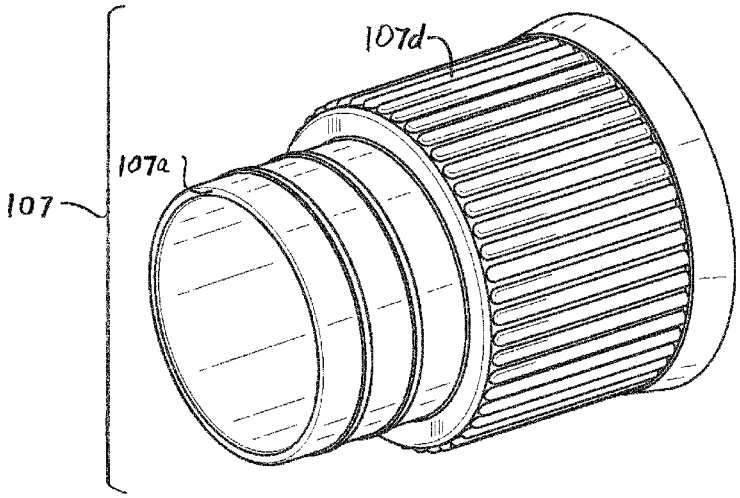
FIG. 27 is a bottom perspective view of the top cap of the cigar tube according to a preferred embodiment of the present invention.
Figure 28:
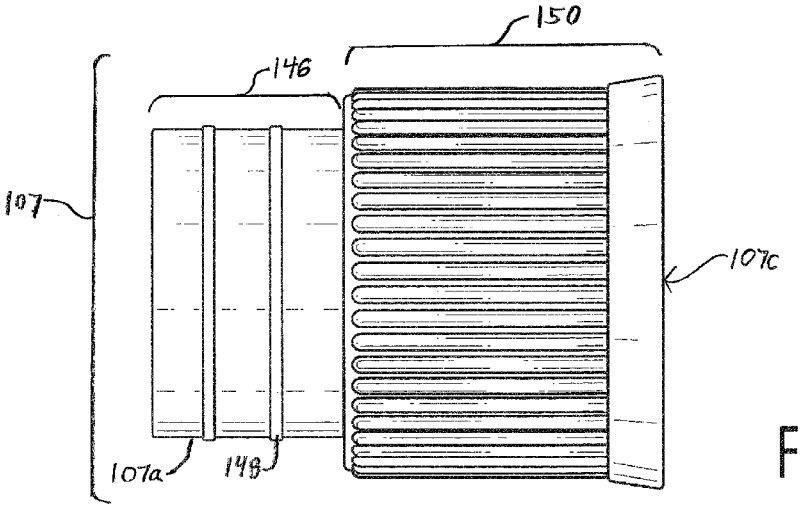
FIG. 28 is a right side view of the top cap thereof.
Figure 29:
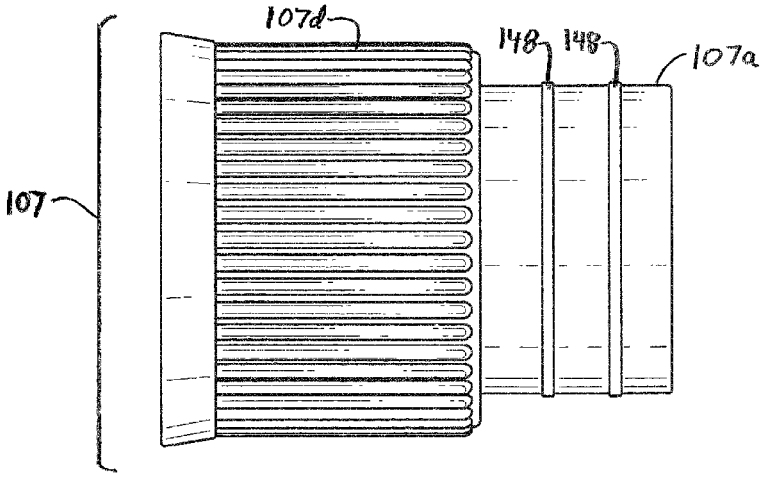
FIG. 29 is a left side view of the top cap thereof.
Figure 30:
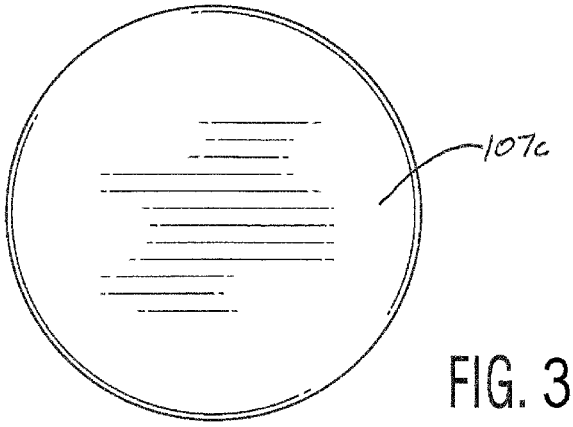
FIG. 30 is a top face view of the top cap thereof.
Figure 31:
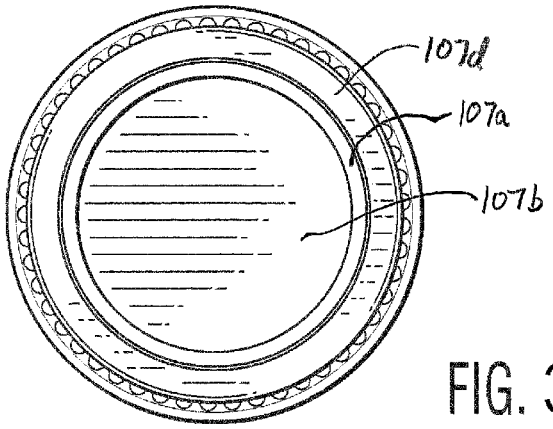
FIG. 31 is a bottom face view of the top cap.
Figure 32:
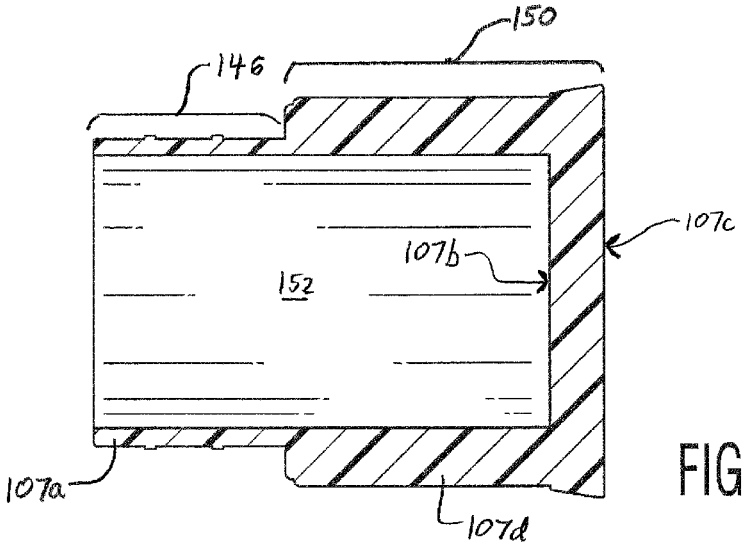
FIG. 32 is a cross-sectional view of the top cap thereof revealing interior of cap.

As seen in the embodiments in FIGS. 19-21, the cigar tube 100 comprises a blade 126 is attached to an interior surface 120 of the tubular member 102 and is configured to longitudinally slice 128 through an outer sheath 130 of a cigar when the cigar 106 is inserted through the opening of the first end into the inner cavity 104. The blade 126 preferably has a triangular shaped profile, exhibiting a cutting profile whose cutting edges are designed in the vertices opposite the base portion which is attached to the inner surface 120 of the tubular member 102.

Figure 37:
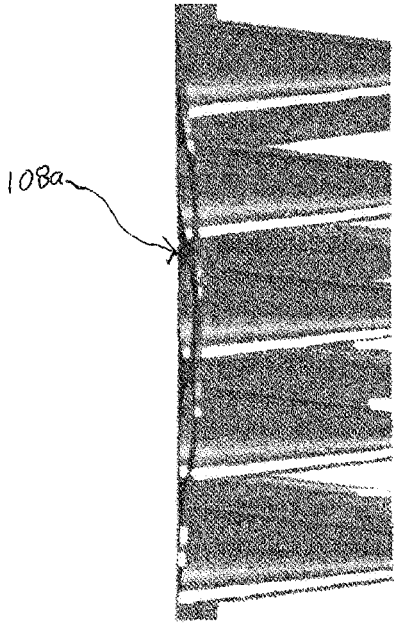
FIG. 37 is a cross sectional view of along cutting view 37-37 of FIG. 12, according to a preferred embodiment of the present invention.
Figure 38:
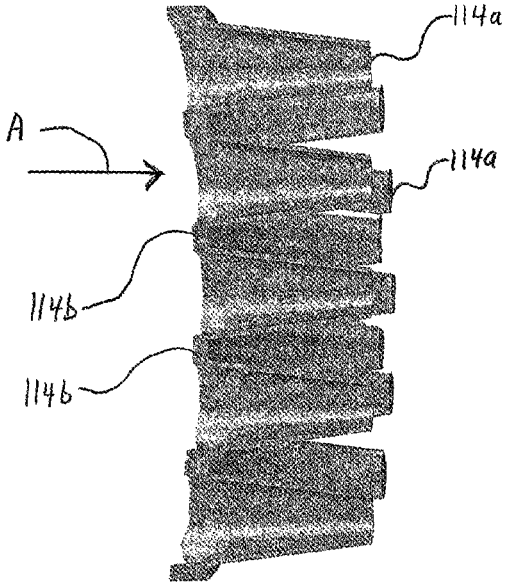
FIG. 38 is a cross sectional view of along cutting view 38-38 of FIG. 12, slightly in perspective, according to a preferred embodiment of the present invention.

As illustrated in FIG. 21, embodiments provide for a cigar tube device 100 having a tubular member 102 with a top end 102*a* opposite a bottom end 102*b*, where the top end 102*a* defines an opening to an inner cavity 104 that is adapted to receive and hold the full length of a cigar 106. In such embodiments, a top cap 107 is removeably attached to the top end, and an ash collection cap 116 is removeably connected to the bottom end 102*b*. Such embodiments further comprise a plurality of truncated cones 114 having truncated distal ends 114*a* opposite interconnected base ends 114*b* as illustrated in FIG. 38 forming a sieved wall 108 disposed within the tubular member 102 for the passage of ashes 122 or tobacco strands 122 from the inner cavity 104 to the ash collection cap 116, as illustrated in FIGS. 37-38. FIG. 37 is a cross sectional view of along cutting view 37-37 of FIG. 12, according to a preferred embodiment of the present invention, showing that the generally planar body 110 preferably has a slightly concave shaped inner surface 108*a*. In an alternative embodiment, the generally planar body 110 has a flat shaped inner surface.

In such preferred embodiment, the plurality of truncated cones 114 forming a sieved wall is configured to retain substantially all the ashes 122 within the ash collection cap 116 upon passage of the ashes 122 through the truncated cones 114 into the collection cap 116. This is because the diameter of the opening of the truncated cone 114 at the base end 114*b* is characterized as larger than the diameter of the opening of the truncated cone 114 at the distal end 114*a*.

Referring to FIGS. 20-21, in yet another preferred embodiment, there is provided a cigar tube 100 for receiving, slicing, and storing a cigar and cigar tobacco filling, comprising a tubular member 102 having a top end 102*a* opposite a bottom end 102*b*, where the top end 102*b* defines an opening to an inner cavity 104 that is adapted to receive and contain the cigar 106 and cigar tobacco filling when inserted therein by a user. A top cap 107 is removeably attached to the top end 102*a*, and a blade 126 is preferably attached to the inside wall of the cigar tube 100 and configured to longitudinally slice 128 through an outer sheath 130 of the cigar 106 when the cigar 106 is inserted through the opening 102*a* into the inner cavity 104 of the cigar tube 100. Such embodiment preferably comprises a tobacco filling collection cap 116 removeably connected to the bottom end 102*b*. As exemplified in FIG. 21, as the cigar is inserted into the cigar tube 100 by a user, the blade 126 slices 128 the outer sheath 130 of the cigar 106, wherein most of the tobacco strands of the cigar are wholly contained within the cigar tube 100, thereby providing a clean and efficient way of removing the tobacco filling from the cigar, in a contained manner. This is because all the tobacco filling is contained within and confined to the inner cavity 104 of the cigar tube 100, as the tobacco filling falls out of the cigar sheath 130 upon the sheath 130 being sliced 128 open.

Through embodiments of the invention, a user can hold the cigar tube 100 in an upright position, insert the cigar into the cigar tube 100 (as seen in FIG. 20) thereby slicing 128 the sheath 130 of the cigar, and then pull the cigar upward and outward of the cigar tube 100, such that the tobacco feeling will fall and substantially remain within the cigar tube 100, allowing for easy disposal or other use of such filling, at the option of the user.

In addition, through embodiments of the invention, a user can hold the cigar tube 100 in an upright position, insert the cigar 106 into the cigar tube 100 (as seen in FIG. 20) thereby slicing 128 the sheath 130 of the cigar, and then store the entire cigar and filling within the inner cavity 104 of the cigar tube 100 (as seen in FIG. 21) by attaching the top cap 107 to the top end 102*a* of the tubular member 102, allowing for easy portability and storage of a sliced 128 cigar 106, at the option of the user.

Figure 36:
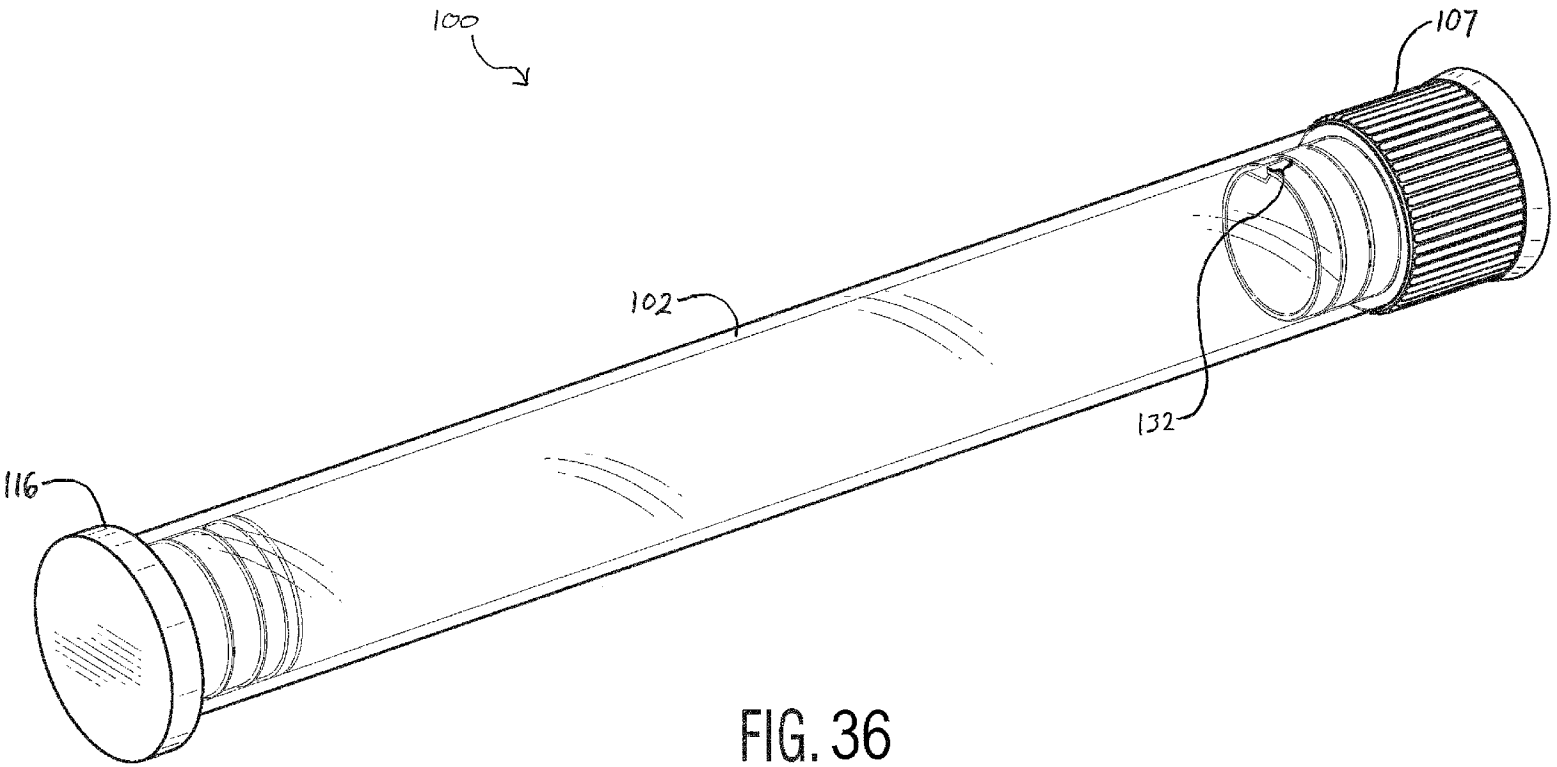
FIG. 36 is a bottom perspective view of the cigar tube with the end caps and ash catcher attached, according to embodiments of the present invention.

In one embodiment, the blade 126 is positioned within the tubular member 102 at a sufficient distance to the top end 102*a* of the tubular member 102 such that, upon attachment of the top cap 107 by insertion of the annular wall 107*a* of the top cap 107 into the top end 102*a* of the tubular member 102, the blade 126 does not engage the annular wall 107*a* of the top cap 107. In an alternative embodiment, the first end cap 107 comprises an annular wall 107*a* defining a longitudinally oriented slit 132 at an inner portion 146 of the top cap 107 configured for the receipt of the blade 126 into said slit 132 when said first end cap 107 is connected to said first end 102*a* of the tubular member 102, as seen in FIG. 36. Such embodiment preferably comprises an ash catcher 108 forming a cross-sectional wall relative to the inner cavity 104 wherein the ash catcher 108 has a plurality of truncated cones 114 projecting from one side of the wall to provide passageways for tobacco strands into the tobacco filling collection cap 116.

The tubular member 102 is preferably elongated and characterized as having a length in excess of the length of the cigar. In one embodiment, the tubular member 102 is characterized as having a length of at least three inches.

Figure 35:
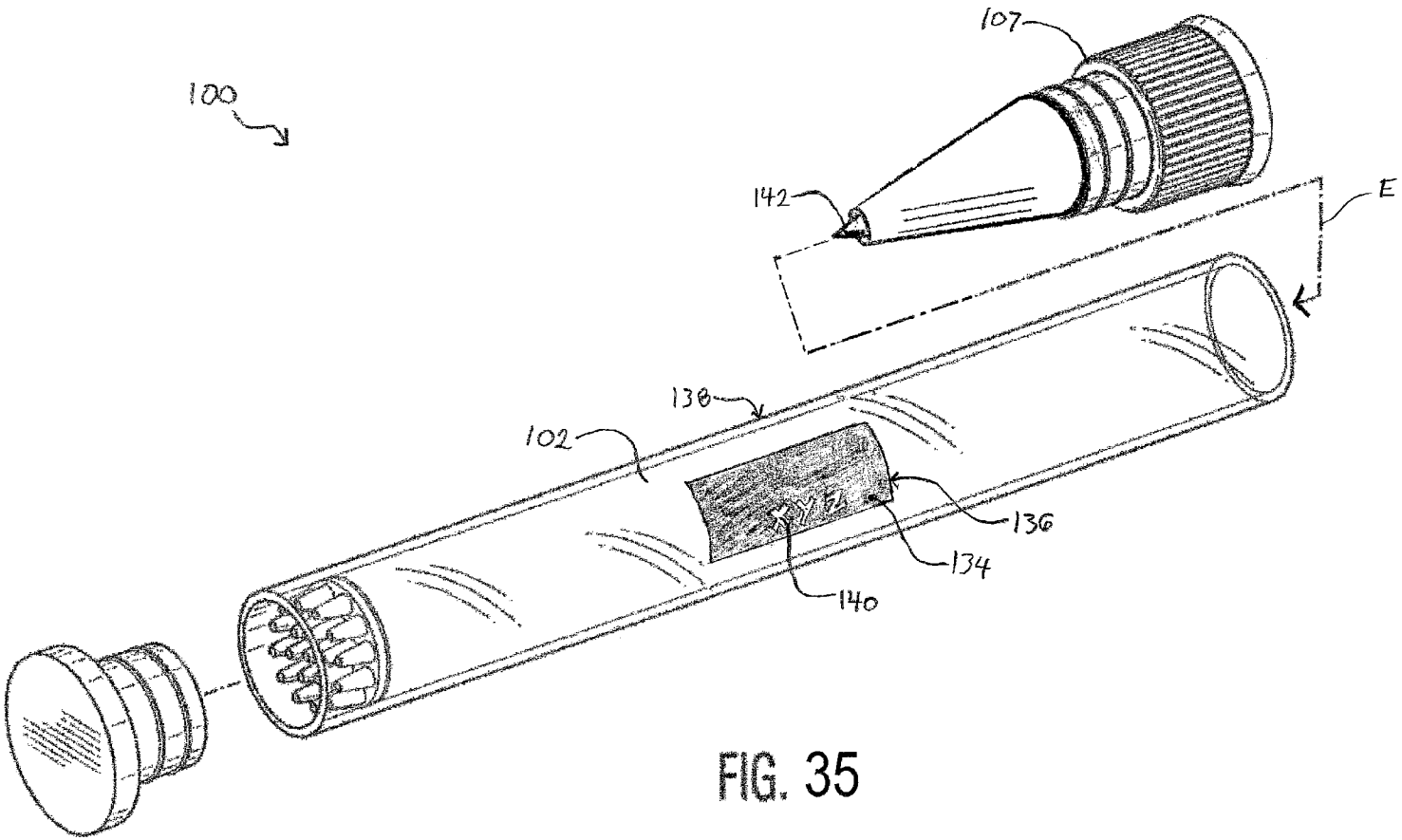
FIG. 35 is an exploded bottom perspective view thereof with the top end cap writing instrument, bottom end cap and ash catcher removed, with a scratch box preferably disposed on the outer surface of the cigar tube as partially scratched off in an exemplary manner, according to embodiments of the present invention.

Referring to FIG. 21 and FIG. 35, in some embodiments of the invention, there is provided a cigar tube 100 comprising a scratch box 134 having a thin film layer 136 disposed on the outer surface 138 of the tubular member 102. The scratch box 134 can be used for identification of the contents contained within the tube 100. As seen in FIG. 21, for a scratch box 134, a film 136 overlays the outer surface 138 of the tube 100 to form the scratch box 134 thereon. There can be one or more scratch boxes 134 disposed on the outer surface 138 of the tubular member 102 of the cigar tube 100. As illustrated in FIG. 35, a user can scratch away all or portions 140 of the scratch box 134 such that the scratch box 134 can be used for identification of the contents contained within the tube 100.

For example, FIG. 21 illustrates an exemplary un-used scratch box 134 disposed on the outer surface 138 of the tubular member 102, according to exemplary embodiments. In particular, FIG. 21 illustrates a scratch box 134 wherein scratch-off has not yet occurred by a user; scratching of the scratch box 134 by a user will reveal the inscription intended by the user. At a user's option, a user may scratch a symbol, Latin and/or non-Latin characters and/or lettering onto the tubular member 102 by scratching the scratch box 134 disposed thereon, preferably by scratching off certain portions 140 of the thin film layer 136 of the scratch box 134, in order to, for instance, identify the type of smoking articles that are contained within such tubular member 102, as seen in FIG. 35.

In one embodiment, the tube scratch box 134 is a way the user can quickly and easily identify the contents that are contained within the cigar tube 100. In yet another embodiment, the tubular device 102 (and/or end caps 107, 116) is/are fabricated and characterized as having a color which is configured to inform a user as to the contents of the smoking articles contained within the tubular device. For instance, the tubular device 102 (and/or end caps 107, 116) can be constructed with a dye characterized as having the color green, and such green colored tubular device 102 (and/or end caps 107, 116) indicates to the user that the device contains, for example, hemp-based rolling papers within the inner cavity 104 of the device. As another example, the tubular device 102 (and/or end caps 107, 116) can be constructed with a dye characterized as having the color red, and such red colored tubular device 102 (and/or end caps 107, 116) indicates to the user that the device contains, for example, a cigar (or tobacco strands) within the inner cavity 104 of the device 100.

In such manners, and through embodiments of the disclosure set forth above, the cigar tube 100 provides product packaging for smoking articles, such as, for instance, cigars 106, rolling papers, cigar wraps, hemp-based rolling papers, pre-rolled cones, tobacco strands, marijuana (including medical grade marijuana), and/or cannabis (including medical grade cannabis), through embodiments of the present invention.

In yet another embodiment, a thin film layer 136 overlays one or more scratch boxes 134 to hide characters or graphics disposed (for example, inscribed) along the outer surface of the tubular member 102, such that a user can scratch off the thin film layer 136 to reveal such characters or graphics. For example, such characters and graphics can identify the type of smoking articles contained within the tube 100. For such an exemplary scratch box 134, when a user rubs off or scratches off the overlaying film 136, some or all of the hidden characters or graphics are exposed. In one embodiment, the one or more scratch boxes 134 is a manner for providing a matching game wherein certain matches of characters or graphics provide a prize. The matches are relative to the scratch boxes 134 and the respective characters or graphics revealed.

In yet another embodiment, there is provided a tubular device 100 for receiving and containing smoking articles comprising a tubular member 102 having a top end 102*a* opposite a bottom end 102*b*, said top end 102*a* defining an opening to an inner cavity 104 adapted to receive and contain smoking articles; a top cap 107 removeably attached to the top end 102*a*; an ash collection cap 116 removeably attached to the bottom end; and a plurality of truncated cones 114 having truncated distal ends 114*a* opposite interconnected base ends 114*b* as illustrated in FIG. 38 forming a sieved wall disposed within said tubular member 102 for the passage of ashes 122 from the inner cavity 104 to the ash collection cap 116. FIG. 38 illustrates a cross sectional view of along cutting view 38-38 of FIG. 12, according to a preferred embodiment of the present invention.

The tubular member 102 is preferably cylindrical in shape as illustrated in FIG. 1. In one embodiment, the tubular member 102 is conical in shape. The smoking articles can comprise, for instance, rolling papers, pre-rolled cones, tobacco strands, marijuana, cannabis, and/or cigar wraps, among other similar smoking articles.

Referring to FIGS. 27-32, the top cap 107 preferably has an inner portion 146 forming an annular wall 107*a* of the top cap 107 adapted to be inserted into the tubular member 102 of the cigar tube 100. The top cap 107 preferably has an outer portion 150 forming an annular wall 107*d* of the top cap 107 adapted to be gripped by a hand of a user. The top cap 107 has an inner top wall 107*b* opposite an outer top wall 107*c*. The annular wall 107*a*, annular wall 107*d*, and inner top wall 107*b* form an open cup-like cavity 152. The inner annular wall 107*a* of the top cap 107 preferably comprises one or more outer annular ribs 148 to facilitate a tightly sealed connection of the top cap 107 to the first end 102*a* of the tubular member 102.

Figure 33:
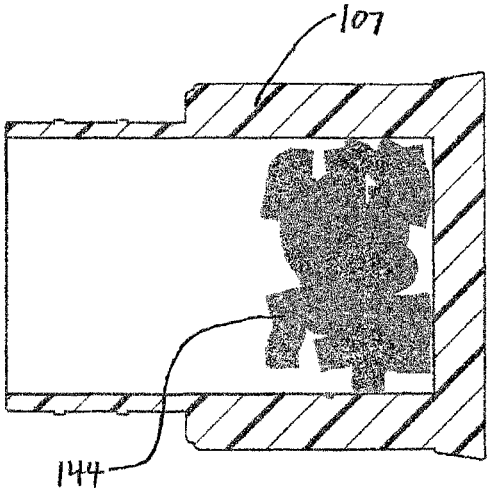
FIG. 33 is a cross-sectional view of a top cap revealing interior of cap with an exemplary flavor enhancement mechanism, according to a preferred embodiment of the present invention.

Referring to FIG. 33, in yet another embodiment, the top cap 107 preferably comprises a flavor enhancement mechanism 144, such that, when smoking articles are contained within the tubular device and engage the flavor enhancement mechanism 144, the mechanism 144 provides an enhancement to a taste and/or scent of the smoking articles.

The tubular member 102 is preferably manufactured in a transparent plastic process, in an injection mold or in another molding process. However, the invention is not limited to this. In a preferred embodiment, the tubular device 102 is constructed with a dye characterized as having a color configured to inform a user as to the contents of the smoking articles contained within the device.

The cigar tube 100 is preferably formed from a material which is highly resistant to impact in order to fully protect and contain the cigar or other smoking articles contained within the cigar tube 100. In view of the fact that the device 100 can initially contain a lighted cigar prior to extinguishment, the cigar tube 100 material should also be non-combustible and have a relatively high melting point. Suitable materials for the cigar tube 100 include but are not limited to plastics such as polypropylene, polyethylene, polycarbonate and nylon. If desired, the cigar tube 100 could be formed from a metal or metal alloy which does not transmit significant amounts of heat to the user.

The tubular member 102 is preferably fabricated as a polycarbonate tube, because that is stronger and more usable over a greater temperature range than an acrylic tube. The tubular member 102 is preferably clear polycarbonate because that is highly transparent to visible light, with better light transmission than many kinds of glass. In an alternative embodiment, the tubular member 102 is fabricated as a polyethylene tube. The top cap 107 and ash collection cap 116 are preferably fabricated as a polyethylene cap, to provide slight flexibility, or alternatively, are fabricated as a polycarbonate cap.

Figure 34:
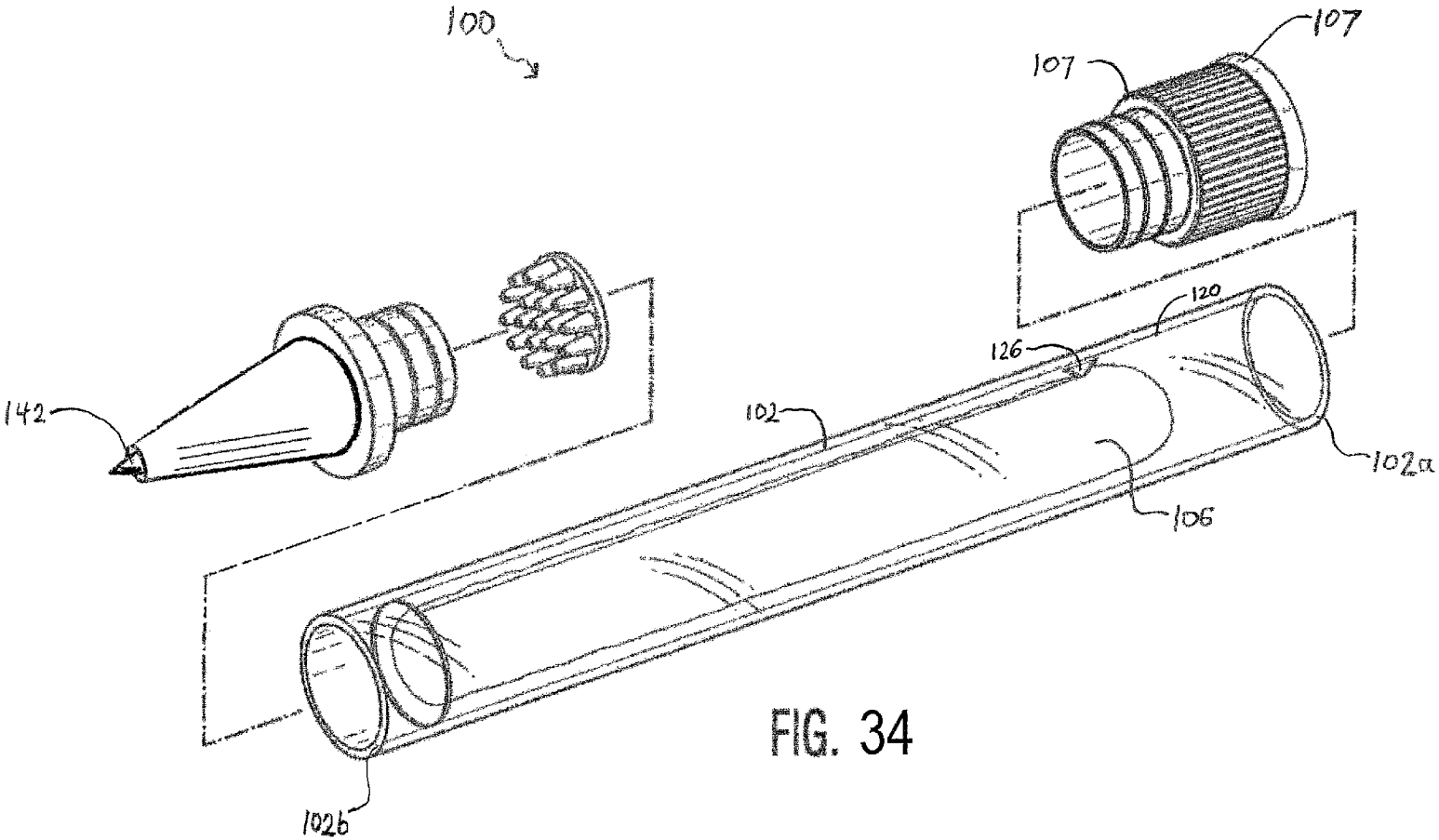
FIG. 34 is an exploded bottom perspective view thereof with the top end cap, a bottom end cap writing instrument and ash catcher removed, according to embodiments of the present invention.

Referring to FIG. 34, in one embodiment, the ash collection cap 116 has a writing instrument 142 attached to an outward (bottom) portion of the ash collection cap 116. The bottom ash collection cap writing instrument 142 can be, for example, a pen or a pencil, disposed upon the outer surface of the ash collection cap 116.

Referring to FIG. 35, in one embodiment, the top cap 107 comprises a writing instrument 142 attached to an inner portion 146 of the top cap 107, such that it can be inserted into the inner cavity 104 of the tubular device. The top cap writing instrument 142 preferably has a sharp tip, as illustrated in FIG. 35. The top cap writing instrument 142 can be, for example, a pen or a pencil, preferably disposed upon the inner portion 146 of the top cap 107. The top cap writing instrument 142 is adapted to be inserted into the tubular member 102 of the cigar tube 100 (as illustrated by dashed line arrow E) as the top cap 107 is attached to the top end 102*a* of the cigar tube 100; and in one embodiment, the top cap writing instrument 142 is configured to pierce one end of a cigar 106 when the cigar 106 is contained within the cigar tube 100. In yet another embodiment, the top cap 107 comprises a writing instrument 142 disposed on the top outer surface 107*c* of the top cap 107.

In one embodiment, the top cap 107 further comprises a battery operatively coupled to a lighter disposed within the open cup-like cavity 152 of the top cap 107 which is configured to light smoking articles at the option of the user.

It will be apparent to persons skilled in the relevant art that various changes in form and detail can be made without departing from the spirit and scope of the invention. While various embodiments of the present invention have been described above, it should be understood that they have been presented by way of example only, and not limitation. Thus, the breadth and scope of the present invention should not be limited by any of the above-described exemplary embodiments, but should only be defined in accordance with the following claims and their equivalents. All patents and publications discussed herein are incorporated in their entirety by reference thereto.

What is claimed is:

1. A cigar tube comprising:

an elongated tubular member having opposite first and second ends and defining a hollow inner cavity disposed between the first and second ends adapted to receive and contain a cigar;

a first end cap removeably connected to the first end for retaining the cigar in the inner cavity;

an ash catcher disposed within said inner cavity, said ash catcher comprising a generally planar body positioned transverse to said tubular member and defining a plurality of apertures, said ash catcher comprising a plurality of truncated cones projecting from said planar body wherein each truncated cone aligns with each respective aperture to provide substantially unidirectional ash passageways from the inner cavity;

an ash collection cap having an annular wall removeably connected to the second end of the tubular member for the receipt, containment and disposal of ashes.

2. The cigar tube of claim 1, wherein the cigar tube is adapted to receive and enclose an entire cigar having a lit end such that ashes from said lit end are directed to fall through said ash catcher and into said ash collection cap.

3. The cigar tube of claim 1, wherein said tubular member is adapted to receive and closely surround a portion of a lit cigar while an opposing unlit portion of the cigar extends outwardly from an opening of the elongated tubular member and is held by a user, such that, when the cigar is smoked by said user, the ashes from said lit end are directed to fall through said ash catcher and into said ash collection cap.

4. The cigar tube of claim 1, further comprising an annular ring encircling an interior surface of the tubular member, wherein the ash catcher is fitted against said annular ring.

5. The cigar tube of claim 1, further comprising an annular ring encircling an interior surface of the tubular member, wherein the ash catcher is fitted against said annular ring and held in place by the annular wall of said ash collection cap when connected to the second end of the tubular member of the cigar tube.

6. The cigar tube of claim 1, wherein the annular wall of the ash collection cap further comprises outer annular ribs to facilitate a tightly sealed connection of the ash collection cap to the second end of the tubular member.

7. The cigar tube of claim 1, wherein the ash collection cap is configured as statically charged to attract ashes into and retain ashes within said statically charged collection cap.

8. The cigar tube of claim 1, wherein the truncated cones are characterized as having a length sufficient to dissipate heat of lit ashes passing through said ash catcher into said ash collection cap.

9. The cigar tube of claim 1, wherein the ash catcher is configured to maintain substantially all ashes within said ash collection cap upon passage of said ashes into said collection cap.

10. The cigar tube of claim 1, wherein the ash catcher is held in place by the annular wall of the ash collection cap when connected to said second end, wherein the truncated cones are characterized as having a length sufficient to provide air space between said cones and said ash collection cap for the collection of ashes and dissipation of heat.

11. The cigar tube of claim 1, further comprising a blade attached to an interior surface of the tubular member and configured to slice longitudinally through an outer sheath of the cigar when the cigar is inserted through said opening into said inner cavity.

12. The cigar tube of claim 1, further comprising a blade attached to an interior surface of the tubular member and configured to slice longitudinally through an outer sheath of the cigar when inserted through said opening into said inner cavity, wherein the first end cap comprises an annular wall defining a slit therethrough configured for the receipt of the blade into said slit when said first end cap is connected to said first end of the tubular member.

* * * * *